United States Patent [19]

Haugen

[11] 4,010,016

[45] Mar. 1, 1977

[54] GAS COMPRESSOR

[75] Inventor: Ronald L. Haugen, Mayfield, Ky.

[73] Assignee: Ingersoll-Rand Company, Woodcliff Lake, N.J.

[22] Filed: May 27, 1975

[21] Appl. No.: 581,218

[52] U.S. Cl. ..... 55/473; 55/269; 415/179; 415/168

[51] Int. Cl.[2] ..... B01D 46/00

[58] Field of Search ..... 55/267–269, 55/400–409, 437–439, 467–473, DIG. 37, 55/DIG. 7; 415/121, 168, 179; 416/95

[56] References Cited

UNITED STATES PATENTS

| | | | |
|---|---|---|---|
| 705,347 | 7/1902 | Harris | 415/DIG. 7 |
| 3,355,097 | 11/1967 | Hornschuch | 415/121 |
| 3,736,812 | 6/1973 | Wellauer | 55/269 |

FOREIGN PATENTS OR APPLICATIONS

| | | | |
|---|---|---|---|
| 33,041 | 1/1928 | France | 415/DIG. 7 |

*Primary Examiner*—Bernard Nozick
*Attorney, Agent, or Firm*—Bernard J. Murphy

[57] ABSTRACT

The compressor, as evidenced in the several embodiments presented herein, comprises, in its essentials, a self-contained gear housing which, centrally thereof, receives a power input shaft for driving a bull gear. The bull gear drives either one or a plurality of other gears which, in turn, are coupled to one or a complementary plurality of gas compressing impellers. Integral with the outer wall of one side of the gear housing is defined one or a same plurality of gas handling structures within which the impeller(s) are confined. The gas handling structures comprise inlet pipes, compression chambers, diffusers and open-ended plenum chambers. According to the requirements of the user, domed enclosures are replaceably bolted to the gas handling structure either directly, or through intervening inter- or after-cooler heat exchangers, and with inter-stage ducting, to define of the gas compressor either a single compressing stage, a plurality of independent stages, or successive, series-coupled compressing stages. The several components comprising the gear housing, gas handling structure, domed enclosure, and heat exchanger are compact, self-contained, cooperatively engageable, and replaceable, to provide the user with optional design configurations for particular applications.

1 Claim, 7 Drawing Figures

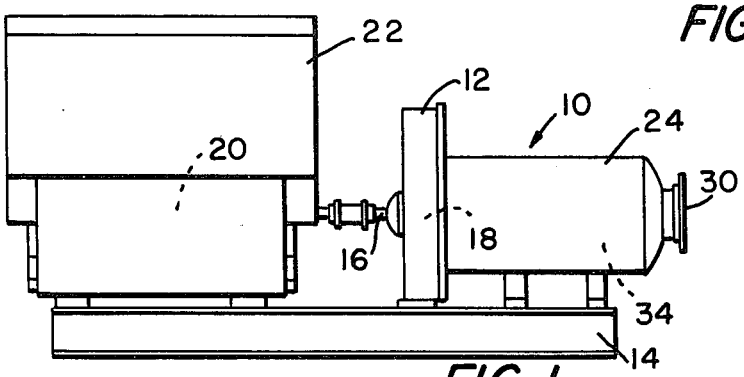
FIG. 1
FIG. 2
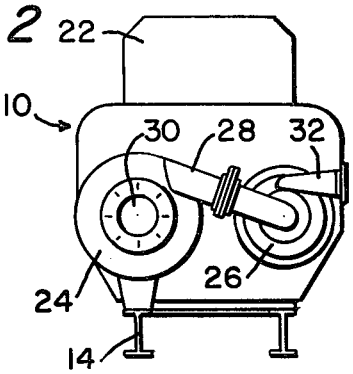
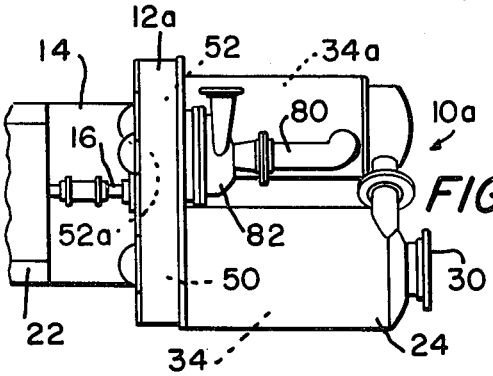
FIG. 4
FIG. 5
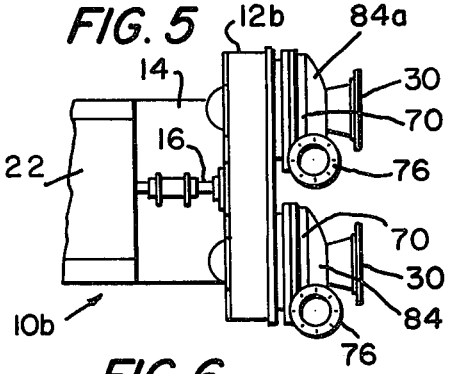
FIG. 6
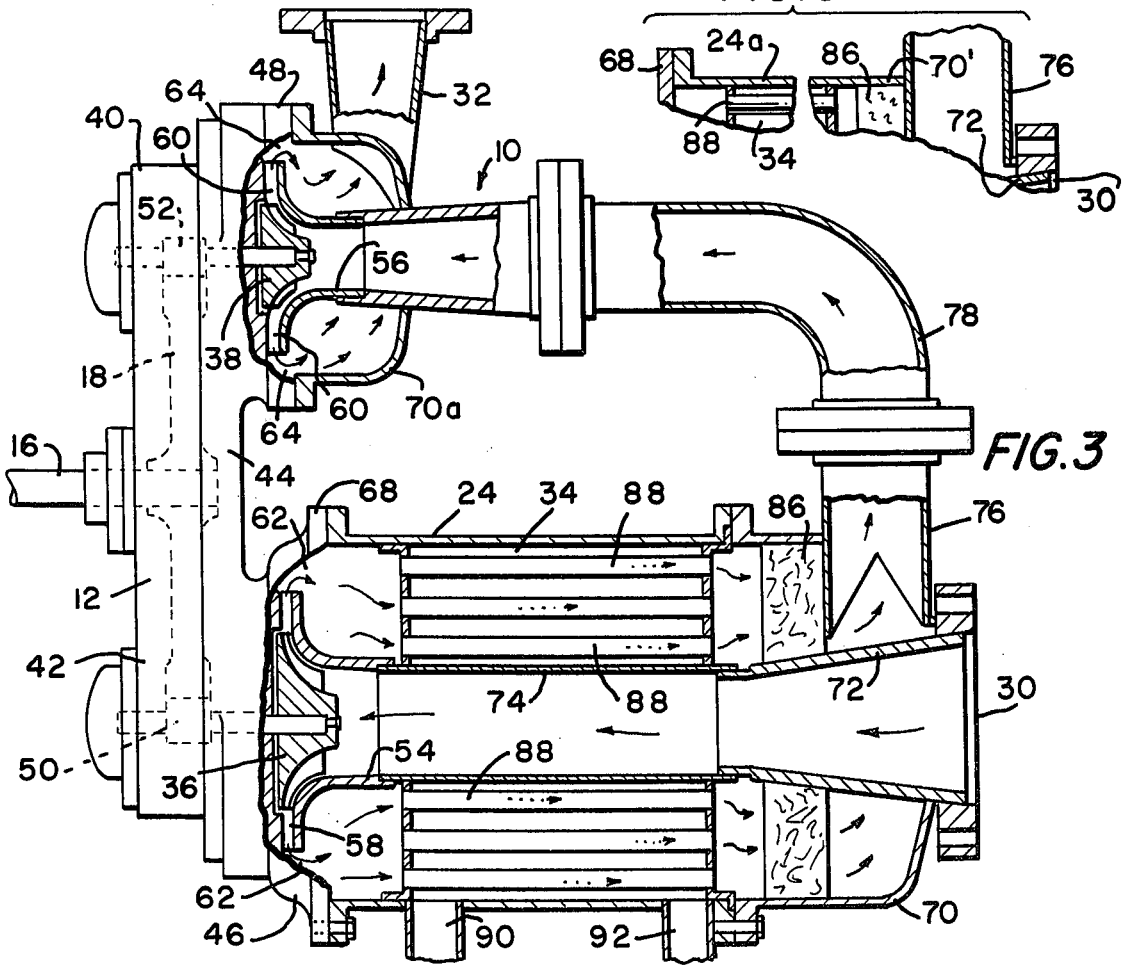
FIG. 3

GAS COMPRESSOR

This invention pertains to gas compressors, and in particular to gas compressor packaging arrangements which, building from efficient, self-contained components, offer a wide flexability of design, respecting output, application, and the like, and which provide for economies in manufacture and maintenance.

In prior gas compressors, the packaging arrangements thereof have been defined by the requirements of the machinery. This necessitates that each arrangement or design must be substantially discrete, requiring considerable manufacturing and maintenance-spares expense. Such prior gas compressors offer little flexability in design, and few efficient, self-contained, integrated components. An exception to this can be found in U.S. Pat. No. 3,355,097 issued to Hanns Hornschuch on Nov. 28, 1967 for a "Fluid Machine". In the aforenoted patent, the Patentee defined fluid machines, such as a gas compressor, which offered an attractive, economical, and readily "maintainable" structure. The patent disclosed, in particular, a gas compressor packaging arrangement in which substantially all inter-stage ducting is self-contained within an end panel or closure is hinged to the housing. According to the present invention, inter-stage ducting —if employed—is external, however, a wide flexibility of design is offered in the packaging of the compressor, according to the invention, with compact, self-contained, mutually couplable, and easily replaceable components.

It is an object of this invention, therefore, to set forth a gas compressor defined of such packagable components, comprising a gear housing; a driving gear and at least one driven gear enclosed within said housing; said gears being in mutual engagement for rotation in parallel axis; said housing having parallel walls; a power input shaft, in penetration of one of said walls, drivingly coupled to said driving gear; an impeller for compressing gas coupled to said one driven gear, externally of said housing, for common rotation with said driven gear; first means for admitting gas to said impeller; and second means for discharging gas from said impeller; wherein said first and second means comprise an integral structure replaceably coupled to said housing in envelopment of, and concentric with, said impeller; one of said first and second means defines an annular chamber; said chamber has a closure head; and the other of said first and second means is in penetration of said closure head.

Further objects and features of this invention will become more apparent by reference to the following description taken in conjunction with the accompanying figures in which:

FIG. 1 is a side elevation, in outline, of a gas compressor according to the invention, the same being shown fixed to one end of a skid or platform and being coupled to a power plant mounted at the other end of the platform;

FIG. 2 is an end view of the arrangement of FIG. 1, taken from the right side of FIG. 1, and showing the inter-ducting and closures for the two stages comprised by this embodiment;

FIG. 3 is a cross-sectional view of the FIGS. 1, and 2 embodiment, taken generally through the plane in which both rotary axes of the two stages are found;

FIG. 4 is a plan view of an alternate embodiment of a gas compressor, according to the invention, in which a series of three compressing stages are provided;

FIG. 5 is yet another embodiment, also in plan view, of the invention, wherein a pair of independent compressing stages are defined;

FIG. 6 is a fragmentary cross-sectional view of a modified version of the FIGS. 1–3 embodiment of the invention;

Figure 7:
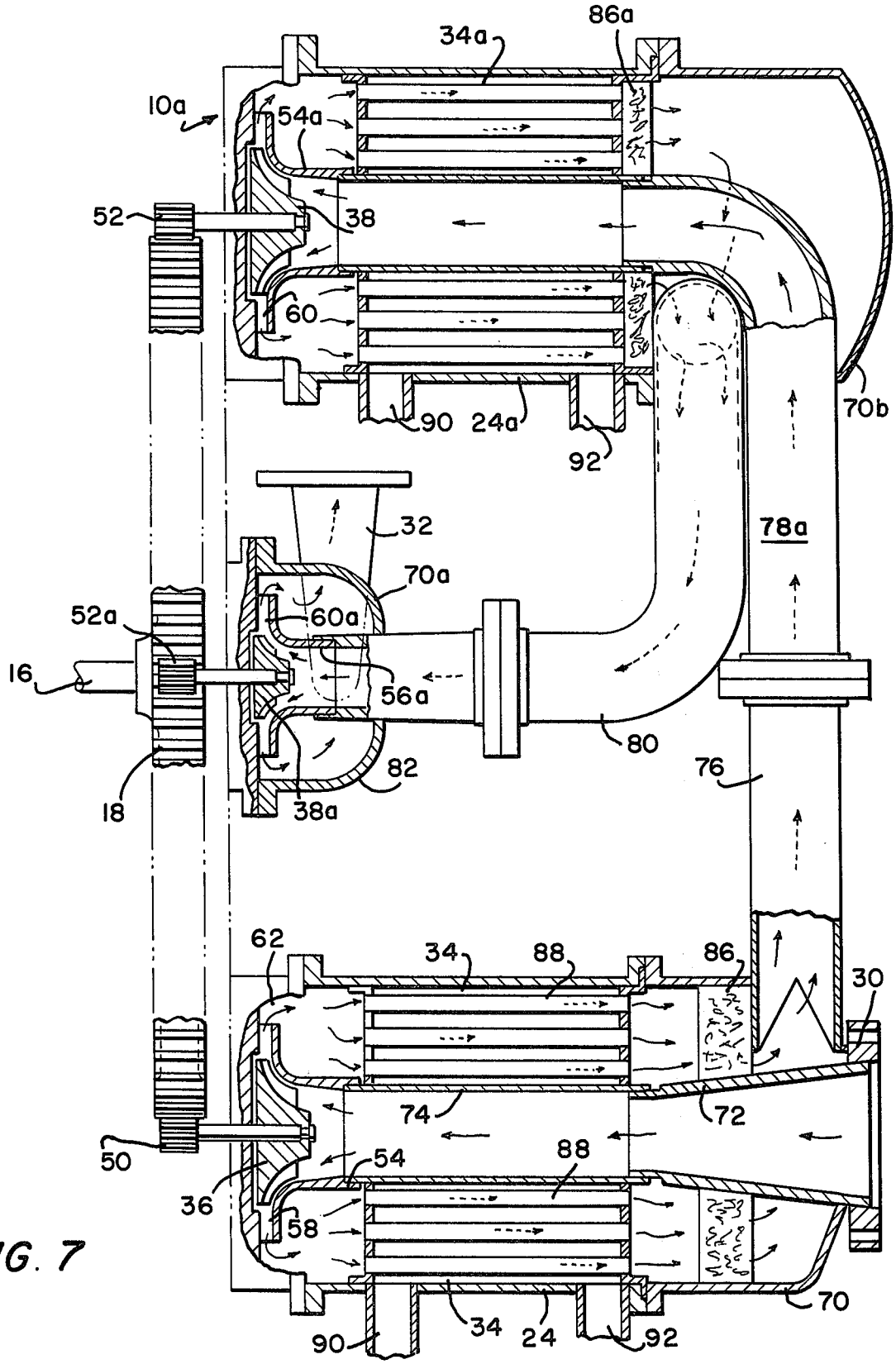
FIG. 7 is a contrived or folded-out depiction of the alternative embodiment of FIG. 4, shown in enlarged scale and in cross-section, with the gear housing omitted for purposes of clarity.

As shown in FIGS. 1 and 2, the gas compressor 10 comprises a gear housing 12, fixed to a platform 14, which has a drive shaft 16 coupled thereto, centrally thereof, via a bull gear 18 for driving gears which power impellers. The drive shaft 16 is coupled to a power plant 20 enclosed within a housing 22. In the end view, FIG. 2, it can be seen that two stages of compression are arranged side by side, each thereof being enclosed within housing shells 24 and 26. Ducting 28 conducts the outlet of the first stage to the inlet of the second stage. A flanged opening 30 comprises the inlet for the first stage, and a tangential conduit 32 carries off the product of the second stage. As will be seen more clearly in FIG. 3, shell 24 is an external wall of an inter-cooler heat exchanger 34.

The embodiment of FIGS. 1 and 2 is shown in more detail, and in cross-section, in FIG. 3, the cross-section taken generally through the plane in which first and second stage impellers 36 and 38 rotate on parallel axes. The gear housing 12 is self-contained being defined by a perimeter wall 40 and parallel side walls 42 and 44. The drive shaft 16 is in penetration of side wall 42 and the impellers 36 and 38 are external of the housing being enclosed in gas handling structures 46 and 48 which are integral with wall 44. The bull gear 18 drivingly engages the first and second stage gears 50 and 52 which in turn power the respective impellers 36 and 38.

Structures 46 and 48 define, centrally thereof, inlet pipes 54 and 56 for admitting gas to each of the stages' impellers, and also comprise diffusers 58 and 60 and open-ended plenums 62 and 64. The first stage has an inter-cooler, i.e., the heat exchanger bolted to the flange 68 of the structure 46 and a domed closure 70 is, in turn, bolted to the heat exchanger. Both the domed closure and the heat exchanger have central pipes 72 and 74 which are matingly engaged to define a common central inlet pipe for admitting gas to the impeller 36 of the first stage. The domed closure also has a tangential outlet pipe 76 for discharging the compressed gas product of the first stage. It will be self-evident that, if desirable, the heat exchanger can be dispensed with, and the domed closure 70 can be bolted directly to the flange 68 of the structure 46.

The tangential outlet pipe 76, comprising part of ducting 28, is, in turn, bolted to a 90° elbow 78 which, in turn, is bolted to a second domed closure 70*a*, the latter being replaceably fixed about the second stage impeller 38. Here too, the second stage impeller domed closure is bolted to structure 48, and has the tangential outlet pipe 32 for withdrawing the compressed gas product. If it will be deemed advisable or desirable, the elbow 78 could be dispensed with an an after-cooler could be bolted in place in the second stage (in the same manner as the inter-cooler 34 is provided for the first stage). Such an after-cooler heat exchanger would be bolted to the second stage structure 48; the gas input for such an embodiment would be supplied directly by pipe 76 into a modified, second stage end closure, and the second stage outlet would be arranged in a side wall of the after-cooler outer shell. Such an arrangement is outlined in FIG. 4.

As shown in FIG. 4 a further embodiment comprises a compact gear housing 12*a* again bolted to a skid or platform 14 but which, in this arrangement, accommodates for three stages of compression. The first stage is substantially identical to the first stage of the embodiment in FIGS. 1 through 3. However, the second stage does have a intercooler heat exchanger 34*a*, and from an end portion thereof is arranged a delivery pipe 80 which conducts the product to a third stage 82. In this arrangement, instead of two driven gears 50 and 52 (FIG. 3) arranged at opposite sides of the bull gear 18, there are three driven gears 50, 52 and 52*a* deployed about the periphery of the bull gear, within the gear housing 12*a*, each driving an impeller.

The embodiment shown in FIG. 5 shows a further packaging arrangement where the compressor 10*b* has single stages of compression provided on that which is basically a same gear housing 12*b;* two compression stages 84 and 84*a* are side by side and supply parallel outputs. As noted before, it is quite within the option of the user to add to one or both of these two stages a heat exchanger, according to the practice shown in FIG. 3 and, if desirable, to so modify the arrangement as to have stage 84 supply its output to stage 84*a* for further compression.

To revert to FIG. 3, domed closure 70 incorporates a demister 86, to collect water vapor which may be entrained in the gas product, and by conventional means (not shown) the collected liquid is drained from the compressor 10. The heat exchanger 34 has throughput pipes 88, arranged in straight columns and rows (to facilitate cleaning), for conducting the gas product therethrough. Ports 90 and 92 supply and discharge coolant to and from the heat exchanger, in a manner well known in the art.

The embodiment shown only in a discontinuous and fragmentary cross-section in FIG. 6 is a modified version of the novel gas compressor of FIGS. 1–3. In this latter embodiment the domed closure 70′ and housing shell 24*a* are integral—the two being formed as a single article of manufacture. The shell 24*a* is bolted (hardware not shown) replaceably to flange 68 of structure 46. Domed closure 70′ (like closure 70, FIG. 3) incorporates the same flanged opening 30, central pipe 72, and outlet pipe 76, and encloses demister 86. Too, shell 24*a* encloses the heat exchanger 34.

In the FIG. 7 contrived or folded-out illustration of the FIG. 4 embodiment, index numbers which carry suffixes are used to signify components which are substantially similar to components which are signified by the same index numbers. The same is true of all figures comprised by this disclosure; similar or like index numbers indicate similar or like items of structure. In FIG. 7 then, the first, second, and third stage gears 50, 52, and 52*a* are shown coupled to their corresponding impellers 36, 28, and 38*a*. The compressed gas product of the first stage is heat exchanged in heat exchanger 34, dried in demister 86, and passed to the doomed closure 70 for conduct through pipe 76 and elbow 78*a* for address to the second stage impeller 38. Again, the product of the second stage is cooled in heat exchanger 34*a*, dried in demister 86*a*, and passed to the domed closure 70*b*. Thence, it is conducted via delivery pipe 80 to the third stage 82 for address to the third stage impeller 38*a*, and discharged via diffuser 60*a* and conduit 32.

While I have described my invention in connection with specific embodiments thereof, it is to be clearly understood that this is done only by way of example, and not as a limitation to the scope of my invention as set forth in the objects thereof and in the appended claims.

I claim:

1. A gas compressor, comprising:

a gear housing;

a driving gear and at least one driven gear enclosed within said housing;

said gears being in mutual engagement for rotation in parallel axes;

said housing having parallel walls;

a power input shaft, in penetration of one of said walls, drivingly coupled to said driving gear;

an impeller for compressing gas coupled to said one driven gear externally of said housing, for common rotation with said driven gear;

first means for admitting gas to said impeller; and second means for discharging gas from said impeller; wherein said first and second means comprise an integral structure replaceably coupled to said housing in envelopment of, and concentric with, said impeller;

one of said first and second means defines an annular chamber;

said chamber has a closure head; and the other of said first and second means is in penetration of said closure head; further including a second driven gear enclosed within said housing and in mutual engagement with said driving gear;

a second impeller for compressing gas coupled to said second driven gear, externally of said housing, for common rotation with said second driven gear;

third means for admitting gas to said second impeller; and fourth means for discharging gas from said second impeller; wherein said third and fourth means comprises an integral structure replaceably coupled to said housing in envelopment of, and concentric with, said second impeller;

one of said third and fourth means defining a further annular chamber;

said further annular chamber has a closure head; and the other of said third and fourth means is in penetration of said closure head of said further annular chamber;

a third driven gear enclosed within said housing and in mutual engagement with said driving gear;

a third impeller for compressing gas coupled to said third gear, externally of said housing, for common rotation with said third gear;

fifth means for admitting gas to said third impeller; and sixth means for discharging gas from said third impeller; wherein said fifth and sixth means comprise an integral structure replaceably coupled to said housing in envelopment of, and concentric with, said third impeller;

one of said fifth and sixth means defines another annular chamber;

said another annular chamber has a closure head; and the other of said fifth and sixth means is in penetration of said closure head of said another annular chamber; and wherein said second, fourth, and sixth means each include demister means for entraining and removing moisture from gas.

* * * * *